US007789984B2

(12) United States Patent
Oda et al.

(10) Patent No.: US 7,789,984 B2
(45) Date of Patent: Sep. 7, 2010

(54) METHOD FOR SUPPLYING PYROTECHNIC MATERIAL SLURRY

(75) Inventors: Shingo Oda, Tatsuno (JP); Hiroyuki Fujii, Tatsuno (JP)

(73) Assignee: Daicel Chemical Industries, Ltd., Osaka (JP)

( * ) Notice: Subject to any disclaimer, the term of this patent is extended or adjusted under 35 U.S.C. 154(b) by 854 days.

(21) Appl. No.: 11/612,306

(22) Filed: Dec. 18, 2006

(65) Prior Publication Data

US 2007/0169864 A1 Jul. 26, 2007

Related U.S. Application Data

(60) Provisional application No. 60/752,382, filed on Dec. 22, 2005.

(30) Foreign Application Priority Data

Dec. 19, 2005 (JP) ..... 2005-364409

(51) Int. Cl.

| | |
|---|---|
| ***C06B 21/00*** | (2006.01) |
| ***C06C 7/00*** | (2006.01) |
| ***D03D 23/00*** | (2006.01) |
| ***D03D 43/00*** | (2006.01) |
| ***F42B 1/036*** | (2006.01) |
| ***F42B 3/12*** | (2006.01) |
| ***F42B 33/02*** | (2006.01) |

(52) U.S. Cl. ..... 149/109.6; 149/1; 149/2; 86/20.1; 102/200; 264/3.1; 264/3.4

(58) Field of Classification Search ..... 149/1, 149/2, 109.6; 102/200; 86/20.1; 264/3.1, 264/3.4

See application file for complete search history.

(56) References Cited

U.S. PATENT DOCUMENTS

| | | | | |
|---|---|---|---|---|
| 3,173,370 | A * | 3/1965 | Landry, Jr. et al. | 102/202 |
| 3,370,537 | A * | 2/1968 | Tepper | 102/336 |
| 3,738,276 | A * | 6/1973 | Picard et al. | 102/401 |
| 4,142,928 | A * | 3/1979 | Stewart | 149/109.6 |
| 4,469,647 | A * | 9/1984 | Speer | 264/3.1 |
| 5,648,634 | A * | 7/1997 | Avory et al. | 102/202.1 |
| 5,686,691 | A * | 11/1997 | Hamilton et al. | 102/202.5 |
| 6,230,624 | B1 * | 5/2001 | Chatley et al. | 102/202.7 |
| 6,272,992 | B1 * | 8/2001 | Chatley, Jr. | 102/202.5 |

(Continued)

FOREIGN PATENT DOCUMENTS

DE 3927400 A1 * 2/1991

(Continued)

*Primary Examiner*—Anthony J Green
(74) *Attorney, Agent, or Firm*—Birch, Stewart, Kolasch & Birch, LLP

(57) ABSTRACT

A method for supplying a pyrotechnic material slurry to a container, includes, taking out a pyrotechnic material slurry, stored inside a storage container, from the bottom portion of the storage container or a vicinity thereof, sealing the exposed surface of the pyrotechnic material slurry with a sealing material, and maintaining the sealed state of the pyrotechnic material slurry in the process of supplying the pyrotechnic material slurry to the container.

9 Claims, 3 Drawing Sheets

U.S. PATENT DOCUMENTS

| | | | | |
|---|---|---|---|---|
| 6,578,487 | B2 * | 6/2003 | Avetisian et al. | 102/202.7 |
| 6,848,365 | B2 | 2/2005 | Avetisian et al. | |
| 6,976,430 | B2 * | 12/2005 | Kinoshita et al. | 102/202.5 |
| 7,004,071 | B2 * | 2/2006 | Avetisian et al. | 102/202.7 |
| 7,316,187 | B2 * | 1/2008 | Hansen | 102/530 |
| 2004/0159043 | A1 * | 8/2004 | Matsumura et al. | 44/628 |
| 2009/0044885 | A1 * | 2/2009 | Brisighella et al. | 149/18 |
| 2009/0044886 | A1 * | 2/2009 | Brisighella et al. | 149/108.6 |

FOREIGN PATENT DOCUMENTS

| | | | |
|---|---|---|---|
| EP | 0780659 | B1 | 8/2004 |
| JP | 9-210596 | A | 8/1997 |
| JP | 2004-115001 | A | 4/2004 |
| JP | 2004-525329 | A | 8/2004 |
| WO | WO-02/46688 | A1 | 6/2002 |

* cited by examiner

METHOD FOR SUPPLYING PYROTECHNIC MATERIAL SLURRY

This nonprovisional application claims priority under 35 U.S.C.§119(a) on Patent Application No. 2005-364409 filed in Japan on 19 Dec. 2005, and 35 U.S.C.§119(e) on U.S. Provisional Application No. 60/752,382 filed on 22 Dec. 2005, which are incorporated by reference.

BACKGROUND OF THE INVENTION

1. Field of Invention

The present invention relates to a method for supplying a pyrotechnic material slurry suitable as a method for loading an ignition agent into an electric igniter.

2. Description of Related Art

A pyrotechnic material (ignition agent) of an electric igniter includes a fuel such as zirconium and an oxidizing agent such as potassium perchlorate. Because a mixture including such components is combustible and explosible in a dry state, safety measures have to be taken with respect to production equipment and handling in the manufacture of igniters using such mixtures, and the production cost is high. For this reason, a method for dispersing the pyrotechnic material in a solvent and handling it in the form of a slurry has been suggested to resolve the problems associated with combustibility and explosiveness of the pyrotechnic material.

JP-A No. 9-210596, JP-A No. 2004-525329 (WO-A No. 02/46688), and US-B No. 6,848,365 disclosed inventions for manufacturing an igniter by using a pyrotechnic material slurry obtained by preparing separately a fuel slurry and an oxidizing agent slurry and mixing the two slurries. JP-A No. 2004-115001 disclosed an invention for manufacturing an igniter by using one pyrotechnic material slurry obtained by mixing a fuel and an oxidizing agent together with a binder or a solvent.

SUMMARY OF INVENTION

The present invention provides a method for supplying a pyrotechnic material slurry to a container, including the steps of taking out a pyrotechnic material slurry, stored inside a storage container, from the bottom portion of the storage container or a vicinity thereof, sealing all the exposed surface of the pyrotechnic material slurry with a sealing material, maintaining the sealed state of the pyrotechnic material slurry in the process of supplying the pyrotechnic material slurry to the container.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF INVENTION

Figure 1:
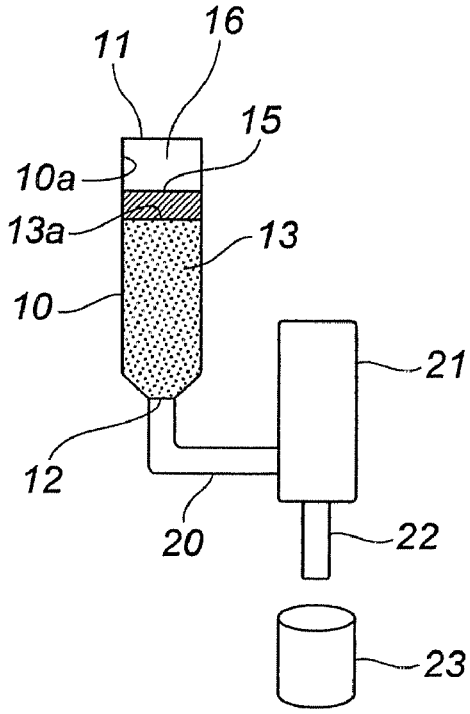
FIG. 1 shows a schematic drawing of a supply apparatus for implementing the supply method in accordance with the present invention.

An embodiment of the invention is a process of loading a pyrotechnic material slurry into an igniter and employs a step of supplying a constant amount of the pyrotechnic material slurry with a metering pump from a storage container containing the pyrotechnic material slurry. In this supply method, the pyrotechnic material slurry can be safely handled without the danger of explosion, as long as the slurry state thereof is maintained.

However, in the process of supplying the pyrotechnic material slurry, the slurry surface (exposed surface) descends and if the slurry remains adhered to the inner wall surface of the storage container, it can burn or explode on drying. Furthermore, if the solvent included in the pyrotechnic material slurry evaporates as the time elapses, the slurry that comes into contact with the inner wall surface of the container on the exposed surface of the slurry can burn or explode. Moreover, as the slurry viscosity increases due to the solvent evaporation, it becomes difficult to supply the slurry and the supplied quantity can be varied.

The present invention provides a method for supplying a pyrotechnic material slurry that is suitable as a method for loading an ignition agent into an electric igniter, this method enabling a safe and stable supply of the pyrotechnic material slurry.

The "exposed surface of the pyrotechnic material slurry" as referred to herein indicates a state prior to being sealed by the sealing material, and there is no exposed surface after sealing with the sealing material.

The term "sealing" as used herein means that the contact of the exposed surface (the surface that is not in contact with the storage container) of the pyrotechnic material slurry with the atmosphere is discontinued before the pyrotechnic material slurry is supplied. The expression "maintaining the sealed state of the pyrotechnic material slurry" means that the contact of the components included in the pyrotechnic material slurry with the atmosphere is discontinued even in the process of supplying the pyrotechnic material slurry. Therefore, as long as the sealed state is maintained, the composition of the pyrotechnic material slurry (in particular, the concentration of the solvent included in the pyrotechnic material slurry) remains unchanged and the risk of combustion or explosion is eliminated.

The sealing material may be of a fixed type or a movable type, provided that sealing is enabled, but a sealing material that moves concomitantly as the exposed surface descends in the process of supplying the pyrotechnic material slurry is preferred.

When a movable sealing material is used, it is preferred that the sealing material be replenished as the exposed surface descends in the process of supplying the pyrotechnic material slurry.

The sealing material is preferably selected from liquids and gels and is not miscible with the pyrotechnic material slurry.

The sealing material may be a combination of two or more sealing materials. In this case, a combination is preferred of a first sealing material selected from liquids and gels and a second sealing material formed of solids, wherein the second sealing material is disposed to be positioned below the first sealing material.

The storage container preferably has a layer of a material selected from polyethylene, polypropylene, fluorine resins, and silicone resins on the surface where it is in contact with the pyrotechnic material slurry in order to ensure smooth supply of the pyrotechnic material slurry.

The method for supplying the pyrotechnic material slurry in accordance with the present invention is advantageous as a method for loading a slurry-like ignition agent into an electric igniter.

The method for supplying the pyrotechnic material slurry in accordance with the present invention enables a safe and stable supply of metered amounts of the pyrotechnic material slurry.

EMBODIMENTS OF THE INVENTION

Figure 2:
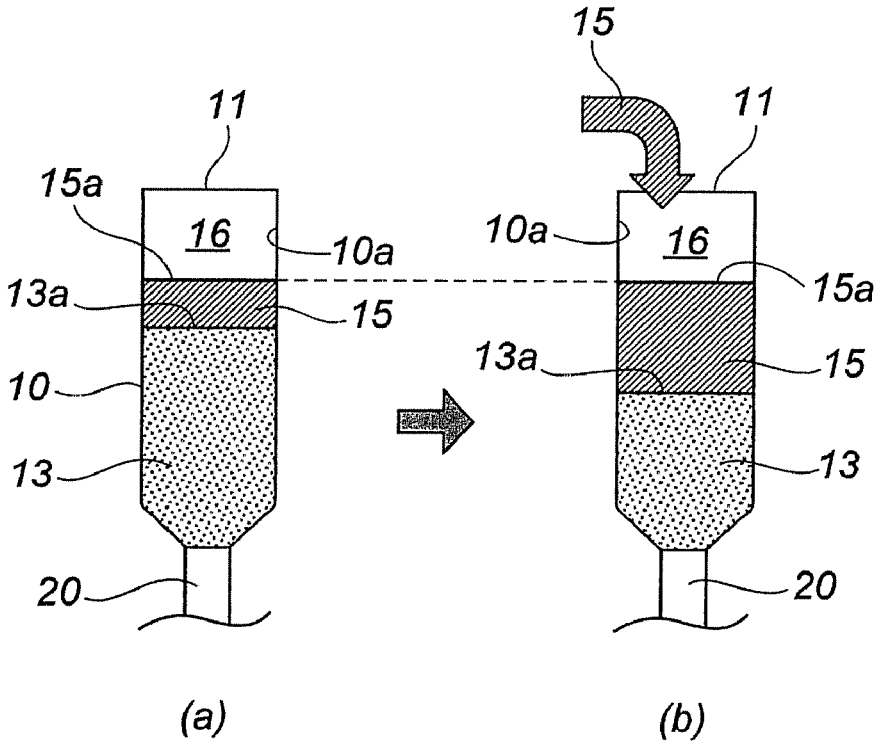
FIG. 2 shows a schematic drawing illustrating an embodiment of the supply method in accordance with the present invention.

(1) Embodiments shown in FIG. 1 and FIG. 2

The embodiments of the present invention will be described below with reference to the drawings. FIG. 1 is a schematic drawing of a supply apparatus for implementing the supply method in accordance with the present invention. FIG. 2 is an explanatory drawing illustrating a method for supplying a pyrotechnic material slurry using the supply apparatus shown in FIG. 1.

<Apparatus for Supplying a Pyrotechnic Material Slurry>

A storage container 10 has a cylindrical shape and has an open portion 11 in the top part and a supply port 12 in the bottom part thereof. The open portion 11 may be in an open state or may be closed with a lid. When it is closed with a lid, a ventilation port, a port for replenishing a sealing material, and a port for injecting a pyrotechnic material slurry can be provided. The supply port 12 is an open-close valve and may be optionally opened and closed.

The storage container 10 is formed from a metal, a synthetic resin, glass, or ceramic, but from the standpoint of preventing the pyrotechnic material slurry from adhering to the inner wall surface of the storage container and enabling a smooth supply, it is preferred that a layer of a material selected from polyethylene, polypropylene, a fluorine resin, and a silicone resin be formed at least on the surface of the storage container that comes into contact with the pyrotechnic material slurry.

The storage container 10 may be also a flexible plastic bag such as used for intravenous dripping in medicine. When a plastic bag is used, because the bag is air-tight sealed after the pyrotechnic material slurry and sealing material have been loaded thereinto, the bag itself shrinks as the volume thereof is decreased due to the supply of the pyrotechnic material slurry, whereby a pressure is applied to the remaining pyrotechnic material slurry.

One end section of a conduit pipe 20 is connected to the supply port 12 of the storage container 10, and the other end of the conduit pipe 20 is connected to a pyrotechnic material slurry discharge device 21 incorporating a metering pump. The pyrotechnic material slurry discharge device 21 has a slurry discharge nozzle 22, and the predetermined quantity of the pyrotechnic material slurry 13 is supplied by the action of the metering pump from the discharge nozzle 22 into a container 23 which is the supply object.

The conduit pipe 20, pyrotechnic material slurry discharge device 21, and slurry discharge nozzle 22 have a layer of a material selected from polyethylene, polypropylene, a fluorine resin, and a silicone resin formed at least on the surface that comes into contact with the pyrotechnic material slurry, similarly to the storage container 10.

The dimensions of structural components constituting the apparatus for supplying the pyrotechnic material slurry can be appropriately set according, e.g., to the loading object, loading quantity, and loading speed of the pyrotechnic material slurry. For example, when the quantity loaded in one cycle is comparatively large, the dimensions of structural components other than the discharge nozzle are set appropriately so that a large discharge nozzle can be used, and when the quantity loaded in one cycle is comparatively small, the dimensions of other structural components are set so that a small discharge nozzle can be used.

The pyrotechnic material slurry discharge device 21 can use a metering pump; for example, NeMo Pumps (pumps of a rotary capacity type) 3ND02G15, 3ND04G15, 4NDP manufactured by Heisin Ltd., Hicera Pumps (valveless rotary plunger pumps) manufactured by Iwaki Co. Ltd., and Rotary Piston Pumps (valveless rotary plunger pumps) manufactured by IVEK Corporation can be used.

<Method for Supplying the Pyrotechnic Material Slurry>

A method for supplying the pyrotechnic material slurry using the supply apparatus shown in FIG. 1 will be explained below with reference to FIG. 1 and FIG. 2.

The predetermined quantity of the pyrotechnic material slurry 13 including a solid component and a solvent is injected from the open portion 11 of the storage container 10 in a sealed state preventing the air from mixing with the slurry. A slurry that was subjected to deaeration treatment in advance is preferably used as the pyrotechnic material slurry 13. No specific limitation is placed on the deaeration method, and the deaeration can be conducted, for example, by using an Awatori Rentaro (AR-Series Mixer) manufactured by Thinky Corporation.

The injected pyrotechnic material slurry 13 passes from the supply port 12 through the conduit pipe 20 into the discharge device 21, but is not discharged from the discharge nozzle 22 before the metering pump is actuated.

After the pyrotechnic material slurry 13 has been injected, the sealing material 15 is introduced to bring it into contact with all the exposed surface 13*a*, the exposed surface (slurry surface) 13*a* is sealed, and contact with the space 16 located between the sealing material 15 and open section 11 is discontinued. The injected quantity of the pyrotechnic material slurry 13 is adjusted so that it can be sealed with the sealing material 15.

The sealing material 15 is selected from liquids and gels, and the sealing material that is not miscible with the pyrotechnic material slurry 13 is preferred. The sealing material that is not miscible with the pyrotechnic material slurry 13 does not dissolve solid components included in the pyrotechnic material slurry 13 and has a specific gravity lower than that of the pyrotechnic material slurry 13. When a liquid or gel is used as the sealing material 15, a movable sealing material is obtained.

A liquid sealing material can be appropriately selected from water, hydrophilic solvents, and hydrophobic solvents according to the type of the solvent included in the pyrotechnic material slurry 13. Furthermore, the viscosity can be increased or decreased within a range in which flowability of the sealing material is maintained.

A gel-like sealing material is not dissolved in the solvent included in the pyrotechnic material slurry 13, may have flowability, and can be selected from polymer gels or inorganic compound gels.

The injected quantity of the sealing material can be set within a range in which the sealed state of the pyrotechnic material slurry is maintained. For example, the quantity of the sealing material can be set equal to or higher than the supplied quantity (or discharged quantity) of the pyrotechnic material slurry supplied from the storage container into the discharge device. Furthermore, the injected quantity of the sealing material can be also set so that the position (height) of the sealing material can be controlled to a range (for example, a fixed height range of the storage container) in which the sealed state of the pyrotechnic material slurry can be maintained.

By sealing the exposed surface 13*a* of the pyrotechnic material slurry 13 with the sealing material 15 in the above-described manner the contact of the exposed surface (slurry surface) 13*a* with the air of the space 16 is discontinued. As a result, the solvent included in the pyrotechnic material slurry 13 does not evaporate, whereby the exposed surface (slurry surface) 13*a*, in particular the contact portion of the exposed surface (slurry surface) 13*a* and inner wall surface 10*a* of the container, is prevented from drying and the amount of solvent in the pyrotechnic material slurry 13 is prevented from changing. Accordingly, the discharge quantity from the discharge device 21 is also stable.

The metering pump is then actuated and the metered discharge of the pyrotechnic material slurry 13 from the discharge nozzle 22 of the discharge device 21 into the container 23, which is the supply object, is started. As the amount of the pyrotechnic material slurry 13 inside the storage container 10 decreases in the course of the discharge, the position of the exposed surface 13*a* descends as shown in FIG. 2(*a*) and FIG. 2(*b*).

In this process, the pyrotechnic material slurry 13 apparently adheres to and remains on the inner wall surface 10*a*, but in the case of a movable sealing material formed from a liquid or gel, because the sealing material 15 itself descends, while being in contact with the inner wall surface 10*a*, the sealing material 15 itself demonstrates a wash-off action (mainly in the case of a liquid sealing material) or a scrape-off action (mainly in the case of a gel sealing material), whereby the residue that adhered to the inner wall surface 10*a* is taken into the sealing material 15 and does not remain in the adhered state on the inner wall surface 10*a*.

Furthermore, as shown in FIG. 2, by replenishing the sealing material 15 as the exposed surface (slurry surface) 13*a* of the pyrotechnic material slurry 13 descends, even when the pyrotechnic material slurry 13 remains adhered to the inner wall surface 10*a*, the sealed state created by the sealing material 15 is maintained and the residue is prevented form contact with the air of space 16. Therefore, combustion or explosion caused by drying can be prevented.

When the sealing material 15 is replenished, from the standpoint of maintaining the preferred sealed state, it is preferred that the sealing material be replenished to maintain a height level identical to that of the exposed surface (slurry surface) 13*a* shown in FIG. 2(*a*) where the pyrotechnic material slurry 13 can adhere to the inner wall surface 10*a*, and even more preferably to maintain a height level (position shown by a broken line in FIG. 2) identical to that of a surface 15*a* of the sealing material 15 shown in FIG. 2(*a*).

Figure 3:
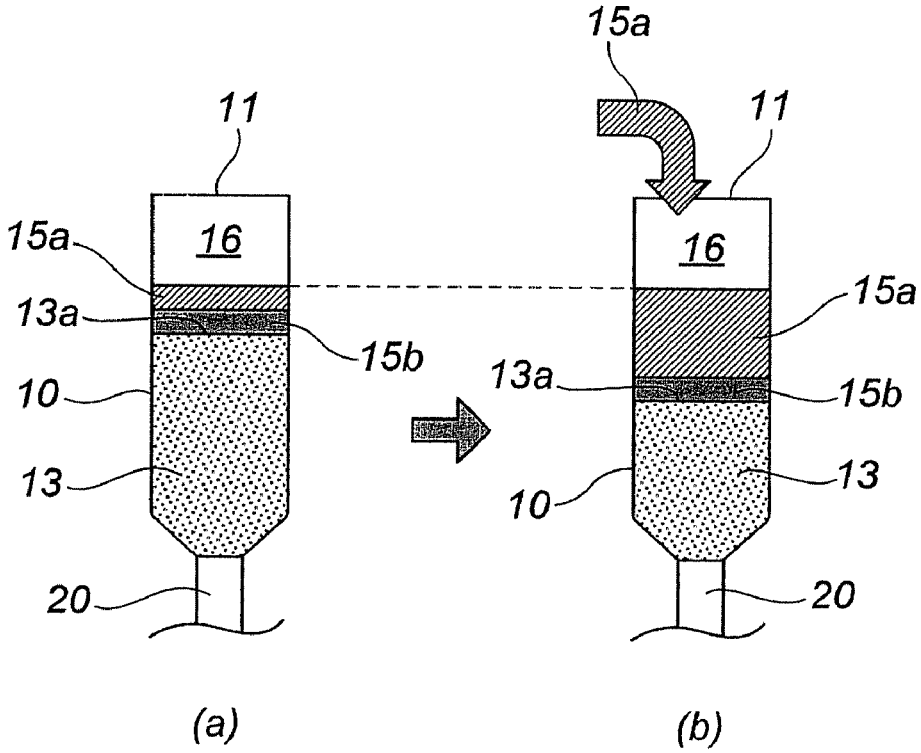
FIG. 3 shows a schematic drawing illustrating another embodiment of the supply method in accordance with the present invention.

(2) Embodiment shown in FIG. 1 and FIG. 3

FIG. 3(*a*) and FIG. 3(*b*) are schematic drawings illustrating another embodiment of the supply method in accordance with the present invention that uses the supply apparatus shown in FIG. 1.

In the present embodiment, a combination of a first sealing material 15*a* formed from a liquid or gel and a second sealing material 15*b* formed from a solid matter is used as the sealing material, and the second sealing material 15*b* is brought into contact with the exposed surface (slurry surface) 13*a* of the pyrotechnic material slurry 13. The first sealing material 15*a* is selected to cause no dissolution, modification, or deformation of the second sealing material 15*b*.

By using such combination of the first sealing material 15*a* and second sealing material 15*b*, the second sealing material 15*b* made from a solid material is introduced between the first sealing material 15*a* and pyrotechnic material slurry 13. As a result, the first sealing material 15*a* and pyrotechnic material slurry 13 are prevented from coming into contact with each other and the restriction placed by the type of the pyrotechnic material slurry 13 on the selection of sealing material is eliminated. Therefore, a material miscible with the pyrotechnic material slurry 13 can be selected as the first sealing material 15*a*.

A material selected from plastics, metals, glass, ceramics, wood, and paper in the form of disks or columns can be used as the solid sealing material. In the case of plastics, the material can be in the form of a film, a sheet, or a block (including a foamed body), and in the case of metals, the material may be in the form of a metal foil.

Also in this embodiment, the first sealing material 15*a* can be replenished as the amount of the pyrotechnic material slurry 13 decreases, in the same manner as in the embodiment illustrated by FIG. 2.

Figure 4:
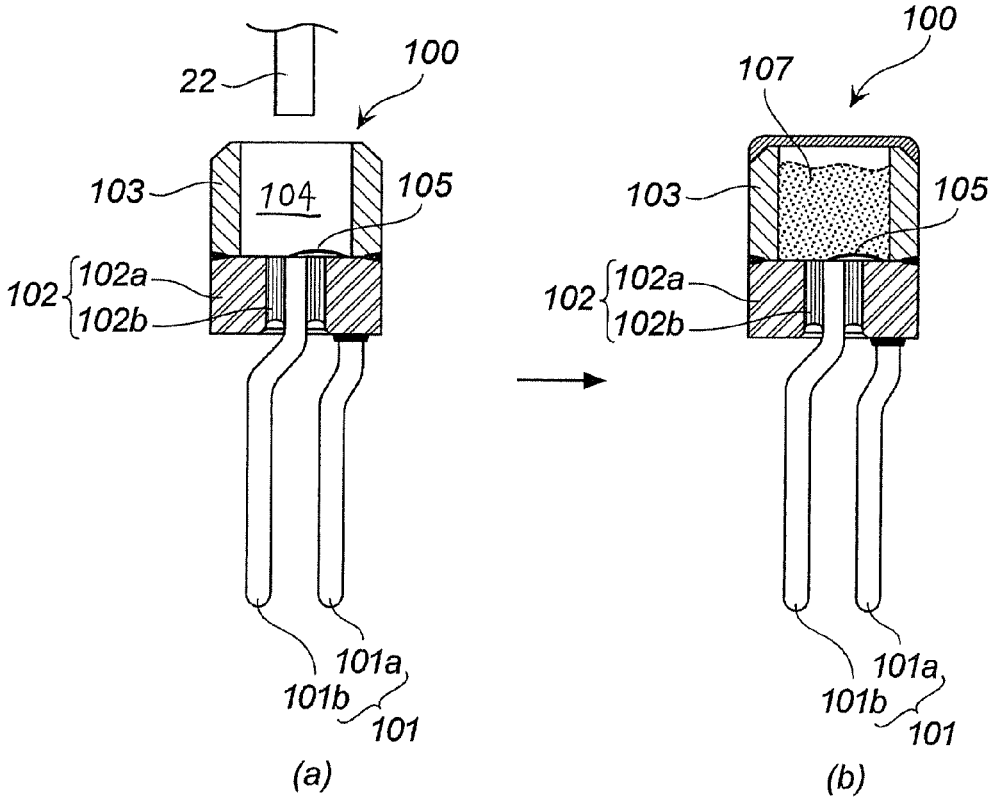
FIG. 4 shows a schematic drawing illustrating yet another embodiment of the supply method in accordance with the present invention.

(3) Embodiment shown in FIG. 1 and FIG. 4

FIG. 4(*a*) and FIG. 4(*b*) are schematic drawings for explaining the embodiment in which the supply method in accordance with the present invention is employed in a method for loading an ignition agent of an electric igniter, in use of the supply apparatus in FIG. 1. The electric igniter shown in FIG. 4 is identical to that shown in the drawings of JP-A No. 2004-115001.

In an igniter 100 (the state before loading a pyrotechnic material) shown in FIG. 4(*a*), a pair of conductive pins 101*a*, 101*b* that receive electric actuation signals are held in an insulated state by a plate-shaped header member 102. A cylindrical charge holder 103 is provided in a vertical condition along the edge of the header member 102. A bridge wire 105 of a heat-generating body for converting the electric energy into thermal energy is provided on the upper surface of the header member 102, that is, on the bottom surface inside the space formed by the charge holder 103 and header member 102 (that is, a pyrotechnic material loading space 104).

One conductive pin 101*a* is joined, so as to enable the electric conductance, to an annular portion 102*a* made from an electric conductor in the header member 102, and the other conductive pin 101*b* is disposed, so that the end surface thereof is exposed at the upper surface of the header member 102, inside an electrical insulating body 102*b* made from glass or the like and loaded into a hole existing in the annular portion 102*a* in the header member 102.

The upper surface of the annular portion 102*a*, the upper surface of the electrical insulating body 102*b*, and the end surface of the conductive pin 101 existing in the annular portion 102*a* are flush mounted, and a bridge wire 105 that is heated by an ignition current is bridged between the upper surface of the annular portion 102*a* and the end surface of the conductive pin 101*b* held by the electrical insulating body 102*b*.

The predetermined amount of a pyrotechnic material slurry (ignition agent slurry) 107 is discharged from the discharge nozzle 22 and loaded into the pyrotechnic material loading space 104 of the igniter 100 shown in FIG. 4(*a*) by using the supply apparatus shown in FIG. 1. The quantity discharged in one cycle varies depending on the type of igniter 100, but is about 10 μL to 150 μL in igniters used in gas generators for air bag devices of general automobiles. Therefore, from the standpoint of productivity, it is preferred that the supply apparatus shown in FIG. 1 be capable of loading an amount within this range in one cycle and that a discharge nozzle with a diameter suitable therefor be used.

A conventional slurry including a fuel, an oxidizing agent, a binder, an additive, and a solvent (for example, such as described in JP-A No. 2004-115001) can be used as the ignition agent slurry. The ignition agent slurry may be obtained by mixing a slurry including a fuel and a slurry including an oxidizing agent that were prepared separately.

A powder selected from zirconium, iron, tin, manganese, cobalt, nickel, tungsten, titanium, magnesium, aluminum, niobium, and mixtures thereof can be used as the fuel. Among them, a zirconium powder is preferred.

A powder selected from perchlorates such as potassium perchlorate, lithium perchlorate, and sodium perchlorate, nitrates such as potassium nitrate, and mixtures thereof can be used as the oxidizing agent. Among them, a potassium perchlorate powder is preferred.

Examples of suitable binders include cellulose resins, urethane resins, and fluorine rubber composition. Furthermore, an additive selected from a glass powder, glass fibers, ceramic fibers, steel wool, bentonite, kaolinite, and mixtures thereof can be used in the pyrotechnic material slurry. In particular, when potassium perchlorate is used as an oxidizing agent component, it is preferred that the binder be selected from hydroxypropyl cellulose, nitrocellulose, and urethane in order to prevent the potassium perchlorate from dissolving in the binder.

An organic solvent such as isopropyl alcohol, methyl ethyl ketone, and hexane can be used as the solvent.

The ignition agent slurry has a viscosity within a range of 1,000 to 500,000 cP(centipoise), preferably 5,000 to 300,000 cP(centipoise).

When the solvent included in the ignition agent slurry has no affinity for the sealing material, the sealing material can be directly used with the ignition agent slurry. For example, when the solvent is a hydrophobic solvent, water can be used as the sealing material.

Furthermore, when the solvent included in the ignition agent slurry has affinity for the sealing material, a second sealing material including a material having no affinity for the solvent or sealing material can be used. For example, when the solvent is a hydrophilic solvent, a hydrophobic (lyophilic) liquid or gel can be used as the second sealing material, and a combination of the first sealing material 15*a* (for example, water) with the second sealing material 15*b* formed from a solid matter (for example, a solvent included in the ignition agent slurry or a plastic sheet that is inert with respect to the first sealing material) shown in FIGS. 3(*a*), (*b*) can be used.

FORMULATION EXAMPLE 1 OF IGNITION AGENT SLURRY

Fuel: zirconium 141 parts by mass.

Oxidizing agent: potassium perchlorate 137.6 parts by mass.

Binder: hydroxypropyl cellulose 2 parts by mass.

Solvent: isopropyl alcohol 64.2 parts by mass.

When the ignition agent slurry of Formulation Example 1 is used, the ignition agent slurry can be sealed by using a foamed plastic sheet (for example, a foamed polyethylene sheet) that is not soluble in isopropyl alcohol and has a specific gravity less than that of the ignition agent slurry as the second sealing material. Furthermore, isopropyl alcohol or an alkane such as hexane, heptane, and octane can be used as the first sealing material.

FORMULATION EXAMPLE 2 OF IGNITION AGENT SLURRY; THE COMPOSITION DESCRIBED IN COLUMN 3, LINES 27 TO 33 OF US-B NO. 6,848,365

Binder: Viton-B, registered trade name, 5 parts by mass.

Solvent: butyl acetate 20 parts by mass.

Fuel/oxidizing agent: zirconium/potassium perchlorate the balance.

When the ignition agent slurry of Formulation Example 2 is used, water can be used as the first sealing agent and injected to come into contact with the ignition agent slurry. However, since the potassium perchlorate of the oxidizing agent can uptake moisture from water of the first sealing material, in this case it is preferred that a second sealing material be disposed between the ignition agent slurry and the first sealing material, in the same manner as in the Formulation Example 1. Furthermore, a second sealing material may be also used when the specific gravity of the first sealing material is less than that of the solvent of the ignition agent slurry (specific gravity of water is larger than that of butyl acetate).

Where the method for supplying a pyrotechnic material slurry in accordance with the present invention is employed, even when the supply is carried out in a continuous mode for a long time, a constant discharge quantity can be obtained from the discharge nozzle 22 and the ignition agent slurry 13 does not adhere to the inner wall surface 10*a* of the storage container 10.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for supplying a pyrotechnic material slurry to a receiving container, comprising:

providing the pyrotechnic material slurry into a storage container;

sealing all exposed surfaces of the pyrotechnic material slurry with a sealing material; and supplying the pyrotechnic material slurry from a bottom portion of the storage container to the receiving container while maintaining the exposed surfaces sealed with the sealing material.

2. The method for supplying a pyrotechnic material slurry according to claim 1, wherein the step of supplying the pyrotechnic material slurry further including, moving the sealing material concomitantly as the exposed surfaces descend.

3. The method for supplying a pyrotechnic material slurry according to claim 1, wherein the step of supplying the pyrotechnic material slurry further including, replenishing the sealing material as the exposed surfaces descend.

4. The method for supplying a pyrotechnic material slurry according to claim 1 or 2, wherein the step of sealing all exposed surfaces further including, sealing all the exposed surfaces with the sealing material selected from liquids and gels and not miscible with the pyrotechnic material slurry.

5. The method for supplying a pyrotechnic material slurry according to claim 1 or 2, wherein the step of sealing all exposed surfaces further including, sealing all the exposed surfaces with the sealing material that is a combination of two or more sealing materials.

6. The method for supplying a pyrotechnic material slurry according to claim 1 or 2, wherein the step of sealing all exposed surfaces further including, sealing all the exposed surfaces with the sealing material that is a combination of a first sealing material selected from liquids and gels and a second sealing material formed of solids and disposed to be positioned below the first sealing material.

7. The method for supplying a pyrotechnic material slurry according to claim 1 or 2, wherein the step of providing the pyrotechnic material slurry further including, providing the pyrotechnic material slurry into the storage container having a layer of a material selected from the group consisting of polyethylene, polypropylene, fluorine resins, and silicone resins on a surface which is in contact with the pyrotechnic material slurry.

8. The method for supplying a pyrotechnic material slurry according to claim 1 or 2, wherein providing the pyrotechnic material slurry further including, providing the pyrotechnic material having an ignition agent of an electric igniter.

9. The method for supplying a pyrotechnic material slurry according to claim 1, wherein the bottom portion is a lowest portion of the storage container.

* * * * *